United States Patent [19]

Edwards

[11] 4,436,149

[45] Mar. 13, 1984

[54] HYDRAULIC SETTING TOOL

[75] Inventor: Arnold G. Edwards, Duncan, Okla.

[73] Assignee: Halliburton Company, Duncan, Okla.

[21] Appl. No.: 389,700

[22] Filed: Jun. 18, 1982

[51] Int. Cl.[3] ..... E21B 23/06

[52] U.S. Cl. ..... 166/120; 166/152; 166/128; 166/332

[58] Field of Search ..... 166/120, 125, 133, 188, 166/123, 126, 181, 152, 63, 332, 212, 237; 285/3, 4, 315

[56] References Cited

U.S. PATENT DOCUMENTS

| | | | |
|---|---|---|---|
| 2,843,399 | 7/1958 | Arterbury et al. | 285/3 |
| 3,122,205 | 2/1964 | Brown et al. | 166/120 |
| 3,298,437 | 1/1967 | Conrad | 166/123 |
| 3,299,955 | 1/1967 | Page, Jr. | 166/120 |
| 3,306,359 | 2/1967 | Edwards, Jr. | 166/120 |
| 3,306,363 | 2/1967 | McZilkey, Jr. | 166/152 |
| 3,356,140 | 12/1967 | Young | 166/332 |
| 3,498,376 | 3/1970 | Sizer et al. | 166/120 |
| 3,556,220 | 1/1971 | Schwegman | 166/120 |
| 3,608,634 | 9/1971 | Cochran | 166/212 |
| 3,735,827 | 5/1973 | Berryman | 166/178 |
| 4,008,759 | 2/1977 | Blackwell | 166/120 |
| 4,253,521 | 3/1981 | Savage | 166/123 |

*Primary Examiner*—James A. Leppink
*Assistant Examiner*—Hoang C. Dang
*Attorney, Agent, or Firm*—Alan T. McCollom; Joseph A. Walkowski; Thomas R. Weaver

[57] ABSTRACT

Apparatus for setting in a bore a well tool of the type having radially expandable anchor means and a mandrel-actuated slidable valve for permitting flow through the tool. Inner and outer sleeves are telescopically interengaged for suspension from a conduit string for lowering into a well bore. A shearable tension sleeve connects the tool to the lower end of the inner sleeve. A vertically shiftable mandrel having a longitudinal bore therethrough is received within the inner sleeve for engaging the well tool valve. A ball is received within a slot in the inner sleeve and is urged into a groove formed in the mandrel by a locking collar disposed about the inner sleeve. Annular pistons are provided between the inner and outer sleeves for moving the inner sleeve upwardly responsive to pressurization of the conduit string. Such upward movement shifts the mandrel downwardly with respect to the inner sleeve and shifts the locking collar to effect locking of the inner sleeve to the mandrel in its shifted position.

17 Claims, 7 Drawing Figures

HYDRAULIC SETTING TOOL

BACKGROUND AND SUMMARY OF THE INVENTION

The instant invention relates to apparatus for setting a tool in a well bore and more particularly to such apparatus in which the setting of the tool is accomplished with hydraulic pressure.

The instant invention can be used to set in a well bore a packer of the type having a conduit therethrough and to thereafter selectively connect and disconnect a pipe or tubing string to the packer conduit. The packer is of the type having elastomeric material disposed about the conduit and further having upper and lower slip assemblies positioned above and beneath the packing material. The conduit includes a valve having an internal sliding sleeve which is selectively movable between one position permitting fluid flow through the conduit and another position shutting off such flow.

Past setting tools have been proposed for setting such packers. One past tool includes a mandrel for inserting into the packer conduit for opening and closing the sleeve valve, an inner sleeve which supports the mandrel and connects it to the conduit string, and a screw jack device disposed between the inner sleeve and an outer setting sleeve.

In setting the above-described packer with the prior art tool, a string is made up wherein the setting tool is connected by its inner sleeve to a tubing string, a breakable tension sleeve is threadably engaged between the lower end of the setting tool and the upper end of the packer conduit, and the setting tool mandrel extends into the packer conduit to maintain a slidable valve in an open position while the tubing string is lowered into the well. When the desired depth for setting the packer in the casing is reached, the tubing string is rotated a predetermined number of times, which rotation operates the screw jack device, thus forcing the setting sleeve downwardly to set the upper packer slips against the sides of the bore. Tension is applied with the tubing to set the lower slips and break the tension sleeve. This leaves the packer engaged in the bore and the setting tool suspended on the tubing string thereabove. Thereafter, the mandrel may be stung into the packer conduit for actuating the valve to provide fluid communication between the tubing string and the bore beneath the packer.

Such past setting tools have proved somewhat unsatisfactory due to their mechanical complexity as well as the necessity for substantial amounts of vertical and rotational movement of the pipe or tubing string and loading of the string in order to set the packer.

Past apparatus have been proposed for setting liner hangers in which hydraulic pressure is used to effect setting. One such apparatus includes an annular collar disposed about a mandrel which is suspended from a tubing string. A ball is dropped down the tubing string to seal the string beneath the collar. A port connects the tubing string to the annulus between the collar and the mandrel and when the string is pressurized, the collar moves upwardly. Setting slips disposed on an inclined surface are suspended from the collar and upward movement along the surface urges the slip outwardly to set the hanger. Such past liner hangers are not adaptable for setting packers of the type above described and do not include a mandrel for actuation of the sliding packer valve.

The instant invention includes inner and outer sleeves telescopically interengaged and adapted to be suspended from a pipe or tubing string for lowering into a well bore. A shearable tension sleeve connects a packer of the above-described type to the lower end of the inner sleeve. A vertically shiftable mandrel is received within the inner sleeve for engaging the packer valve. A ball and groove device disposed between the inner sleeve and the mandrel maintain the mandrel in a fixed position relative to the sleeve. Pressurization of a hydraulic chamber disposed between the inner and outer sleeves urges the inner sleeve upwardly thus shearing the tension sleeve and setting the tool. Such upward movement causes movement of the ball to permit downward movement of the mandrel relative to the inner sleeve. Thereafter, the mandrel may be stung into the packer conduit for actuating the valve as desired.

DETAILED DESCRIPTION OF THE INVENTION

Figure 1A:
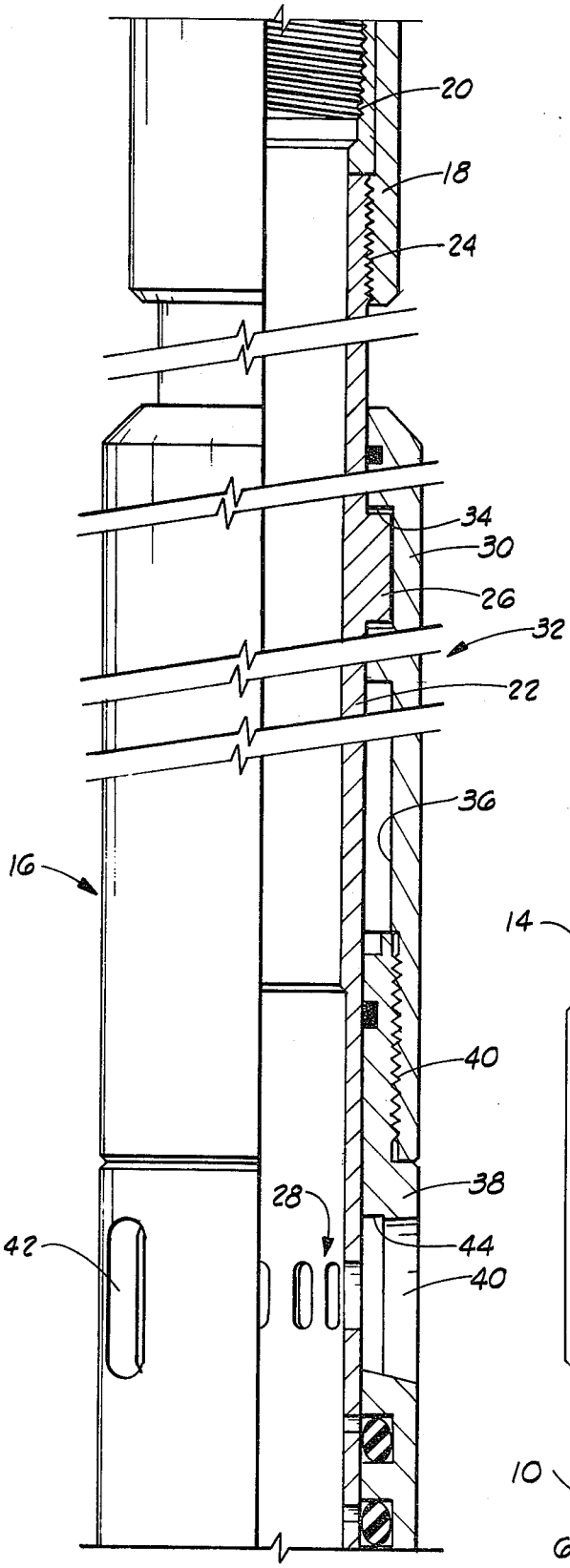
FIGS. 1A–1F are successive downward continuations, shown partly in quarter-section and partly in half-section, of the preferred embodiment of the invention combined with a circulating valve, drag blocks and a packer.
Figure 1B:
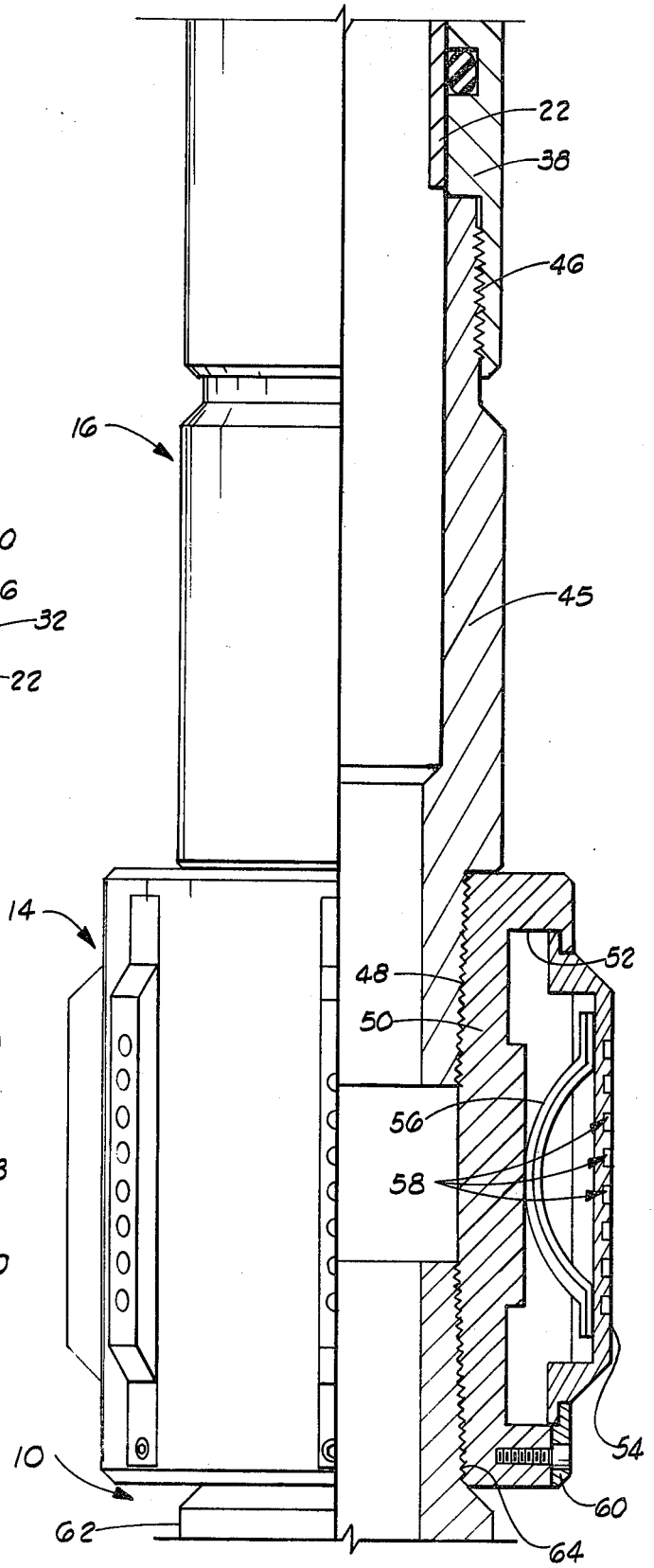

Turning now to FIGS. 1A–1F, indicated generally at 10 is a setting tool which incorporates the preferred embodiment of the invention. Setting tool 10 is used to set a well tool or packer, indicated generally at 12, in the bore of a well. Setting tool 10 is set up on a string which includes (from the bottom up): packer 12, setting tool 10, a drag block assembly indicated generally at 14 and, mounted on the top of the drag block assembly, a conventional circulating valve indicated generally at 16. The circulating valve is connected to a conventional coupler 18 which include threads 20 for connection to a tubing string (although a pipe string may easily be used instead) for lowering the string into a well bore to set the packer.

Circulating valve 16 may be of the type shown in U.S. Pat. No. 3,315,747 to Farley et al. and assigned to the assignee of the instant application. Examination of the Farley patent may be made for a detailed description of the structure and operation of the circulating valve. Circulating valve 16 includes an inner mandrel 22. Mandrel 22 is generally cylindrically shaped and is connected to coupler 18 via threads 24. The mandrel includes radially opposing lugs, one of which is lug 26, which extend outwardly from the mandrel surface. Also included in the mandrel is a plurality of ports, indicated generally at 28 which extend through the mandrel about its circumference.

A J-slot sleeve 30 extends about the circumference of inner mandrel 22 and includes a J-slot indicated generally at 32 having an upper portion 34 and a lower portion 36. The J-slot is formed on the radially inner side of the J-slot sleeve and is constructed to permit lug 26 on the inner mandrel to be received within the upper or lower portion and to be moved between the two portions by means of longitudinal and rotational movement of inner mandrel 22. The J-slot sleeve is threadably connected to a valve body 38 via threads 40. Valve body 38 is cylindrically shaped and includes ports, like ports 40, 42, about its circumference. Valve body 38 also includes an annular space 44 formed completely about the circumference of the valve body radially inward from the ports. As can be seen in FIG. 1A, space 44 permits fluid communication between inner mandrel 22 (via ports 28 of the inner mandrel) and the well bore into which the valve is lowered regardless of the radial orientation of the inner mandrel. A lower valve body 45 is threadably connected via threads 46 to the lower end of valve body 38. Lower valve body 45 includes threads 48 at its lower end which threadably engage the lower valve body to a drag block mandrel 50. Drag block mandrel 50 is substantially cylindrically shaped and includes six openings, like opening 52, which are equally spaced about the circumference of the drag block mandrel. Each opening contains a drag block and associated structure like drag block 54 in opening 52. Drag block 54 is radially biased outwardly by a spring 56. Each of the drag blocks includes a plurality of disks, like those indicated generally at 58 on drag block 54 for engaging the surface of a well bore in order to increase the coefficient friction between the drag blocks and the well bore surface. A keeper, like keeper 60, is mounted on mandrel 50 at the lower end of each drag block to maintain the drag blocks in their respective openings.

As will later become more fully apparent in discussing the operation of the string depicted in FIGS. 1A–1F, drag block assembly 14 serves to resist movement of the outer cylindrical portion of circulating valve 16 including lower valve body 45, valve body 38, and J-slot sleeve 30. When the drag blocks engage the surface of a well bore, longitudinal and rotational tubing string movement may be used to shift lug 26 on inner mandrel 22 to lower portion 36 of the J-slot. Such inner mandrel movement effects downward sliding of ports 28 on the mandrel for sealing off from ports 40 on valve body 38 to shut off fluid communication between inner mandrel 22 (and hence the conduit tubing to the surface) and the well bore via ports 40. Thereafter, the inner mandrel may be manipulated by tubing movement in order to shift ports 28 upwardly to the configuration shown in FIG. 1A to permit such fluid communication.

Included in setting tool 10 is a setting or outer sleeve 62, such having a generally cylindrical shape and being threadably engaged with drag block mandrel 50 via threads 64. The setting sleeve includes a downward facing annular shoulder 66. A bore 68 permits fluid communication between the interior of the setting sleeve and the well bore. A radially inward extension or annular piston 70 extends about the inner circumference of the setting sleeve. A second bore 72 is formed in the sleeve beneath piston 70. A second piston 74 is positioned beneath piston 70 and extends about the interior of the sleeve like piston 70. A third bore 76 (FIG. 1E) is located at the lower end of the setting sleeve. The bottom of the setting sleeve includes an annular tapered surface 78 which, as will later be more fully apparent, is provided for engaging structure on packer 12 for setting the packer.

Contained within setting sleeve 62 is an inner sleeve 80. Inner sleeve 80 is in sealing engagement with the outer sleeve at several locations, one of which is provided by an O-ring 82. The inner sleeve includes radially outward extensions or pistons 84, 86. Each piston is annular shaped and is in sealing engagement about its circumference with the radially inner surface of setting sleeve 62 via O-rings 88, 90. Likewise, pistons 70, 74 on the setting sleeve include O-rings 92, 94 for sealing pistons 70, 74 to the radially outer surface of inner sleeve 80. The spaces between pistons 84, 70, and between pistons 86, 74 define hydraulic chambers 96, 98. Each hydraulic chamber includes a bore 100, 102 which connects its associated chamber to the interior of sleeve 80. The interior of inner sleeve 80 includes two downward facing annular shoulders 104, 106, each of which extends about the circumference of the sleeve, and an upward facing annular shoulder 108, such also extending about the circumference of the sleeve.

A plurality of slots, like slots 110, are formed in sleeve 80 beneath shoulder 108. Each slot permits communication between the interior and exterior of the sleeve and each includes a ball, like ball 112 in slot 110. The balls are maintained in their slots by a locking collar 114 which extends about the circumference of inner sleeve 80 and covers each of the slots.

Collar 114 is maintained in its place by a plurality of shearable means or shear pins, one of which is shear pin 116. Each pin is received within radially aligned bores formed in inner sleeve 80 and in locking collar 114. As will later be explained, when sufficient downward force is applied to locking collar 114 with respect to the inner sleeve, the shear pins shear and permit the locking collar to slide along the sleeve.

The locking collar further includes an annular groove 118 formed about the inner circumference of the collar. An O-ring 120 rests on the top of collar 114. Piston 74, located above O-ring 120, includes a lower surface 122 which is referred to herein as stop means. A lock ring 124 is received within a radially inward facing channel 126 formed at the lower end of locking collar 114. A second channel 128 is formed about the circumference of inner sleeve 80 at its lower end.

Figure 1C:
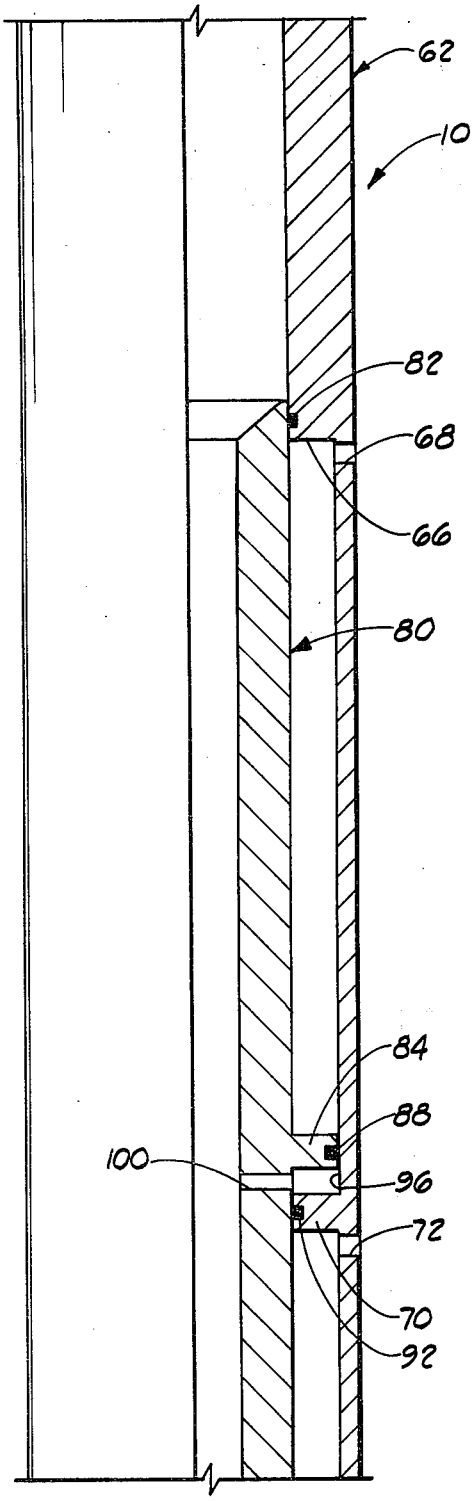
Figure 1D:
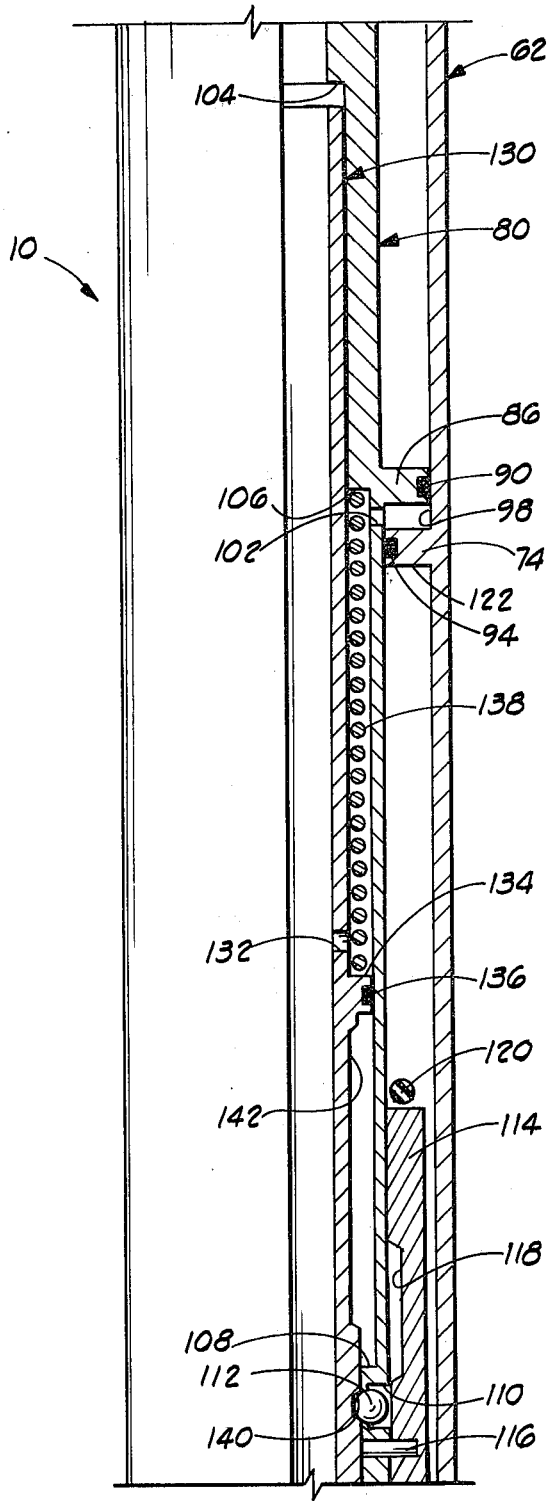

In FIG. 1D, a mandrel 130 is received within inner sleeve 80. The mandrel includes a bore 132 which places the interior of the mandrel in fluid communication with an annular space between the mandrel and the radially inner side of inner sleeve 80. An upward facing shoulder 134 is formed about the circumference of mandrel 130 beneath bore 132. An O-ring 136 beneath shoulder 134 seals the mandrel to the radially inner surface of inner sleeve 80 about the circumference of each. A spring 138 is compressed in the annular space between shoulders 134, 106. Annular grooves 140, 142 are formed on the radially outer surface of the mandrel about its circumference. Groove 140 receives each of the balls, like ball 112. Each ball is maintained in the groove by locking collar 114 thus preventing relative longitudinal movement between the mandrel and inner sleeve 80. Groove 142 is wider than groove 140 and is referred to herein as a second groove. Mandrel 130 extends downwardly into packer 12. Packer 12 is connected to the lower end of inner sleeve 80 via a tension collar 144 (also referred to herein as attaching or shear means). Collar 144 includes threads 146, 148, such connecting the collar to inner sleeve 80 and to a packer conduit 150, respectively. Tension collar 144 also includes a narrowed portion 152 which, as will later be explained, breaks during setting of packer 12 in order to separate the setting tool from the packer.

Figure 1E:
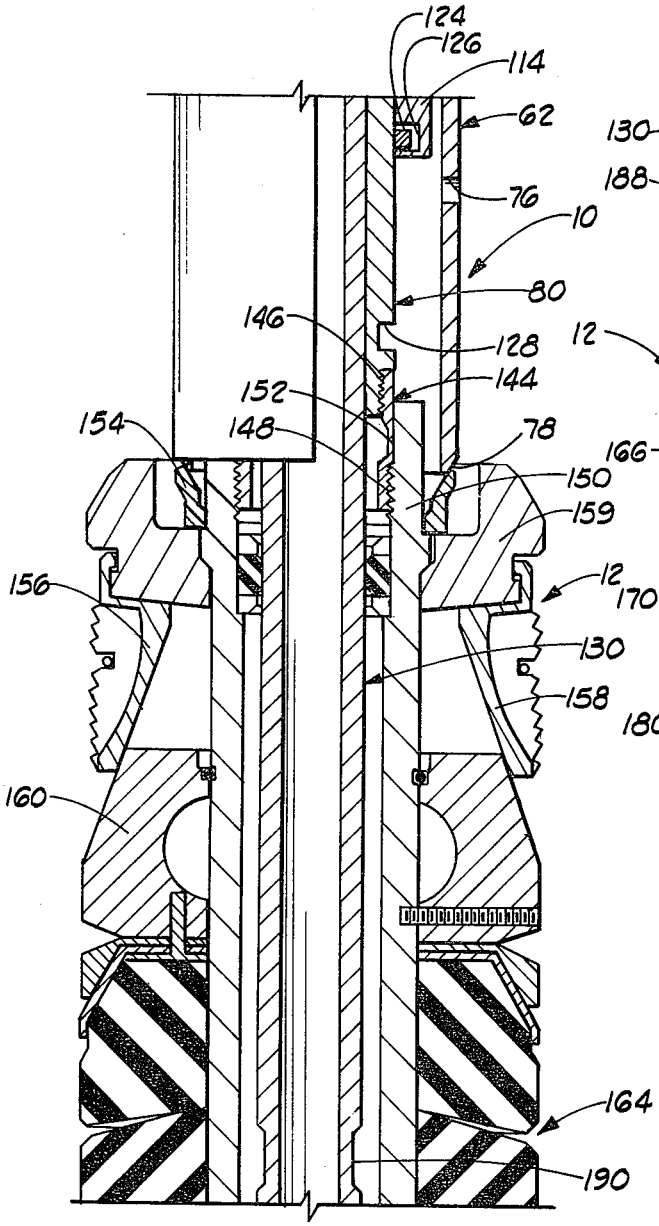

Packer 12 is of conventional structure and includes a split ring 154 which, in the condition shown in FIG. 1E, maintains slips such as slips 156, 158 in an upper position as shown. The slips are suspended from an annular lock ring housing 159. A conventional annular wedge 160 is provided to force slips 156, 158, respectively, outwardly as the slips move downward relative to the wedge. Elastomeric packers 164 are confined about conduit 150 between upper wedge 160 and a lower wedge 166. The lower wedges coact with lower slips such as slips 170, 172 in a conventional manner to force the slips outwardly to engage the well casing.

A cylindrical sliding valve sleeve 174 is closely received within the lower end of conduit 150. The valve sleeve includes a pair of ports 176, 178, which, when the valve sleeve is in its uppermost condition as shown, are sealed off from a pair of ports 180, 182 formed in conduit 150. Valve sleeve 174 includes upwardly extending fingers such as fingers 184, 186. The fingers include upper portions **184*a*, 186*a*. Conduit 150 includes an annular groove 188 which receives the upper portions 184*a*, 186*a* of the fingers to maintain the valve in its upper position. Mandrel 130 includes an annular groove 190 formed about its radially outer surface. As will become apparent in the discussion of the operation of the packer and the setting tool, groove 190 is engagable with finger portions 184*a*, 186*a*** in order to shift the valve between its upper closed position and its lower open position.

In operation, the string as shown in FIGS. 1A–1F is connected to conventional tubing string via threads 20 and is lowered into a well bore. Lug 26 is contained within upper portion 34 of J-slot 32 thus maintaining inner mandrel 22 in its upper position so that ports 28 are in alignment with annular space 44 to permit fluid communication between the inner mandrel (and hence the tubing string) and the well bore.

Figure 1F:
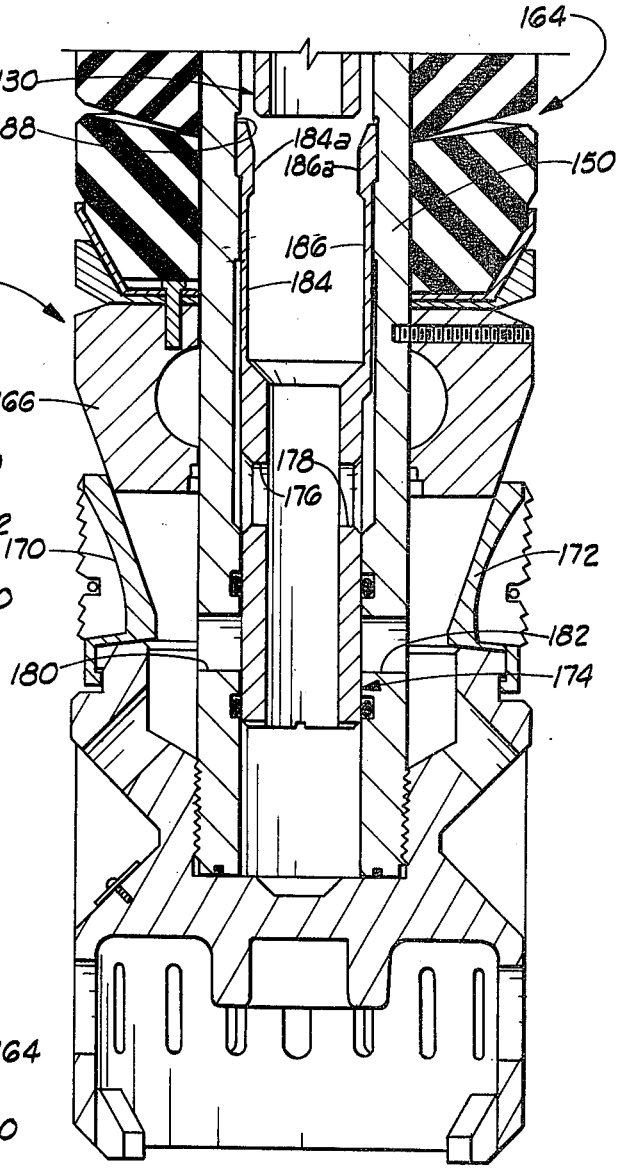

Setting tool 10 is in the configuration shown in FIGS. 1C and 1D. Locking ball 112 is urged into groove 140 on the mandrel by locking collar 114. The locking collar is restrained from vertical movement with respect to inner sleeve 80 by means of shear pin 116. Thus mandrel 130 is restrained, due to the ball received into groove 140, from vertical movement with respect to inner sleeve 80. Valve 174 remains in its closed position as shown in FIG. 1F while the string is lowered into the well.

While the string is lowered, circulating valve 16 permits filling of the string (including the tubing) with whatever fluids are present in the well bore. When the level at which it is desired to set packer 12 is reached, further lowering of the string is stopped. Prior to setting the packer, the circulating valve is closed to seal the interior of the string from the well bore. This is achieved by slight rotation and longitudinal movement of the drill string in order to move lug 26 from its position within upper portion 34 of the J-slot into lower portion 36. Drag block assembly 14 provides the necessary rotational and vertical drag to permit movement of lug 26 from its upper to its lower position. The tubing is now pressurized by pumping fluid into the tubing at the surface.

Such pressurization urges fluid in the string through bore 100 in mandrel 80 into hydraulic chamber 96. In a similar manner, fluid passes through bore 132 in the mandrel and through bore 102 in inner sleeve 80 into hydraulic chamber 98. The pressurization of hydraulic chambers 96, 98 causes upward movement of inner sleeve 80 due to the pressure applied to the lower sides of pistons 84, 86. Since mandrel 130 is locked to the inner sleeve as described above, the mandrel likewise moves upward. Upward movement of the inner sleeve pulls packer 12 upwardly via tension collar 144. Upward movement of conduit 150 results in the spreading of split ring 154 by contact with lower surface 78 of setting sleeve 62, causing upper slips 156, 158 to spread outwardly against the sides of the well bore due to the action of wedge 160. Continued upward movement of conduit 150 pulls lower slips 170, 172 over lower wedge 166, thus forcing lower slips 170, 172 outwardly into engagement with the sides of the well bore. Packer 12 is at this point set in the well bore.

Continued application of pressure in the tubing causes further upward movement of inner sleeve 80 until tension collar 144 breaks along narrowed portion 152. When the tension collar breaks, the inner sleeve is free to move upwardly until O-ring 120, riding on the top of locking collar 114, strikes lower surface 122 of piston 74. Thus, since the locking collar, the inner sleeve and the mandrel are locked together via the action of ball 112 in groove 140, each has moved upwardly by the same amount.

After O-ring 120 is compressed between locking collar 114 and piston 74, continued application of pressure in the tubing causes shearing of shear pin 116. When pin 116 shears, inner sleeve 80 continues further upward movement. Such additional upward movement of the inner sleeve permits ball 112 to be received within groove 118 on the locking collar. As soon as the ball is received within groove 118, spring 138 causes downward movement of mandrel 130 since the ball is no longer received within groove 140 of the mandrel. As mandrel 130 moves downwardly, groove 142 slides aqross slot 110. Groove 142 momentarily receives the ball to permit slot 110 and ball 112 to move above groove 118 as inner sleeve 80 continues upward movement. Upward movement of the inner sleeve continues until channel 128 is opposite lock ring 124. The conventional lock ring is biased inwardly and when channel 128 moves opposite the ring, the ring is partially received within channel 128 thus locking collar 114 to inner sleeve 80. The configuration of setting tool 10 is now as shown in FIG. 2.

Figure 2:
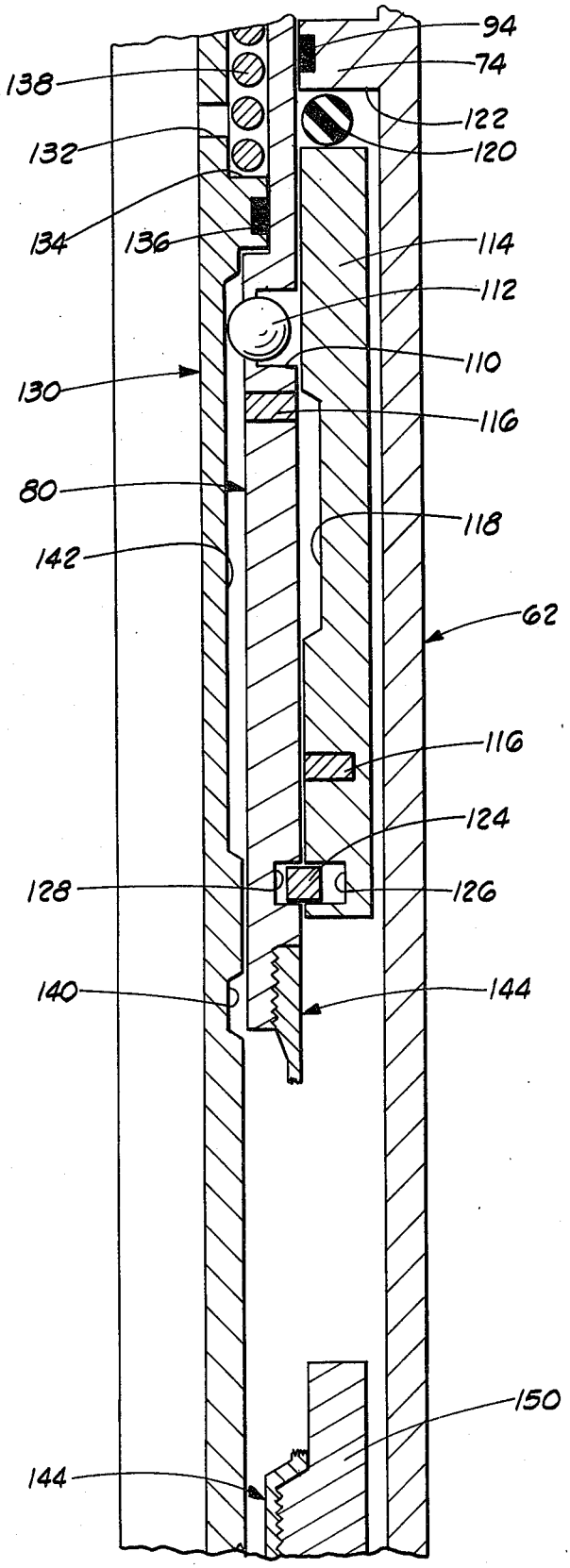
FIG. 2 is an enlarged view of a portion of the view of FIGS. 1D and 1E after setting of the packer.

In the configuration of FIG. 2, locking collar 114 is locked to inner sleeve 80 at a lower position than that at which shear pin 116 fixed the collar to the inner sleeve. Since conduit 150 has been moved upwardly while mandrel 130 has been permitted to move downwardly, the end of the mandrel is received within valve 174 and the valve is urged to its lowest position, thus aligning ports 176, 180 and ports 178, 182 to permit fluid flow from beneath the packer into the tubing (not shown). When the valve is so opened, groove 190 at the lower end of mandrel 130 receives upper portions **184*a*, 186*a*** of the fingers (also not shown).

It should be noted that conduit 150 may be moved downward slightly through application of increased annulus pressure when mandrel 130 is inserted into packer 12, due to the seal between conduit 150 and mandrel 130. In a similar fashion, if valve 174 is not in its lower, open position, application of tubing pressure in excess of annulus pressure will move conduit 150 downwardly. As conduit 150 "floats" with respect to the upper and lower slips to a certain extent, this is not detrimental, as such action in a downward direction tends to set upper slips 156, 158 more firmly; pressure from below in the well bore will set lower slips 170, 172 more firmly (when valve 174 is closed).

If it is later desired to close the valve, the tubing string is lifted, thus lifting mandrel 130 and raising the valve to its upper closed position (as shown in the drawings). As the valve moves upwardly, the upper portions 184*a*, 186*a* of the fingers are received within groove 188 of conduit 150 and the mandrel continues upward movement thus leaving the valve locked in its closed position.

If thereafter, it is again desired to open the valve, the tubing string is lowered until surface 78 on outer sleeve 62 is set down on lock ring housing 159. When outer sleeve 62 is so positioned, mandrel 130 has engaged the upper portions 184*a*, 186*a* of the valve fingers in groove 190 and has moved the valve into its lower open position. It should be noted that due to the length of groove 142 on the mandrel, it is not possible for the weight of the tubing string to be applied through mandrel 130 to the bottom of the packer. Groove 142 permits a range of vertical travel, restricted by ball 112, of mandrel 130. When groove 142 is of sufficient length, the most force which can be applied through mandrel 130 to the bottom of the packer is the downward biasing force of spring 138, plus the tubing/annulus differential pressure times the differential area in the vicinity of O-ring 136.

It is to be appreciated that additions and modifications may be made to the instant embodiment of the invention without departing from the spirit thereof as defined in the following claims.

I claim:

1. Apparatus for setting in a bore a well tool of the type having radially expandable anchor means and a mandrel-actuated slidable valve for permitting flow through the tool, said apparatus comprising:

inner and outer sleeves telescopically interengaged and adapted to be suspended from a tubing string for lowering into the bore;

means for attaching a shearable connector to the lower end of said inner sleeve for suspending such a tool therefrom;

a vertically shiftable mandrel received within the inner sleeve for engaging the well tool valve;

means for maintaining said mandrel in a predetermined upper position with respect to said inner sleeve;

means for telescopically moving said inner sleeve upwardly relative to said outer sleeve, said outer sleeve engaging said anchor means to effect setting of the tool responsive to such movement; and means for maintaining said mandrel in a predetermined lower position with respect to said inner sleeve subsequent to such setting of the tool.

2. The apparatus of claim 1 wherein said outer sleeve is rigidly attached to said tubing string and said inner sleeve is telescopically received therein.

3. The apparatus of claim 1 wherein said means for maintaining said mandrel in a predetermined upper position includes a slot formed through said inner sleeve having a ball contained therein and a groove formed on the radially outer surface of said mandrel for receiving a portion of said ball when said slot is adjacent said groove.

4. The apparatus of claim 3 wherein said maintaining means further includes a locking collar mounted for sliding along the radially outer surface of said inner sleeve, said locking collar being fixable to said inner sleeve with shearable means so that said collar urges a portion of said ball into said mandrel groove.

5. The apparatus of claim 4 wherein said locking collar includes a groove formed on its radially inner surface for receiving a portion of said ball when said slot is adjacent said locking collar groove.

6. The apparatus of claim 1 wherein said means for telescopically moving said inner sleeve upwardly with respect to said outer sleeve includes a hydraulic chamber formed between said inner and outer sleeves, such movement occurring responsive to pressurization of said inner sleeve.

7. The apparatus of claim 1 wherein said means for maintaining said mandrel in a predetermined lower position with respect to said inner sleeve includes a slot formed through said inner sleeve having a ball contained therein and a groove formed on the radially outer surface of said mandrel for receiving a portion of said ball when said slot is adjacent said groove.

8. The apparatus of claim 7 wherein said maintaining means further includes a locking collar mounted for sliding along the radially outer surface of said inner sleeve, said locking collar being fixable at a predetermined location to said inner sleeve with a lock ring and channel means so that said collar urges a portion of said ball into said mandrel groove.

9. The apparatus of claim 8 wherein said groove is vertically elongate so that said second predetermined position permits a range of vertical mandrel movement.

10. The apparatus of claim 5 or 9 wherein said apparatus further includes biasing means disposed between said inner sleeve and said mandrel for biasing said mandrel downwardly with respect to said inner sleeve.

11. An apparatus for setting a well tool in a bore, said well tool having radially expandable anchor means and a conduit including a valve shiftable between upper and lower positions for selectively permitting fluid flow through said conduit, said apparatus being of the type having a setting sleeve for engagement with said anchor means to effect tool setting, said apparatus comprising:

means for suspending the apparatus from a tubing string for lowering into the bore;

an inner sleeve contained within said setting sleeve and shiftable between upper and lower positions;

a vertically shiftable meandrel contained within said inner sleeve for engagement with said well tool valve;

shear means mountable on the lower end of said inner sleeve for suspending said well tool therefrom;

piston means disposed between said setting sleeve and said inner sleeve for effecting upward movement of said inner sleeve responsive to pressurization thereof; and means for selectively maintaining said mandrel in a first predetermined position with respect to said inner sleeve, said maintaining means including:

a first groove and a second groove thereabove formed on said mandrel;

a slot in said inner sleeve;

a locking collar disposed about said inner sleeve and having a third groove formed in its radially inner surface;

shearable means for shearably attaching said locking collar to said inner sleeve adjacent said slot; and a ball disposed between said mandrel and said inner sleeve, said ball being received in said first groove and said slot and maintained therein by said locking collar prior to shearing of said shearable means, and being received in said second groove and said slot subsequent to said shearing, said third groove being adapted to receive said ball when said third groove is adjacent said inner sleeve slot during at least a portion of the movement of said ball from said first groove into said second groove.

12. The apparatus of claim 11 wherein the setting sleeve includes stop means mounted on its radially inner surface for shearing said shearable means when said locking collar strikes said stop means during upward movement of said inner sleeve.

13. The apparatus of claim 12 wherein said apparatus further includes biasing means disposed between said inner sleeve and said mandrel, said biasing means biasing said mandrel downwardly with respect to said inner sleeve.

14. The apparatus of claim 13 wherein said apparatus further includes lock ring and channel means for maintaining said locking collar at a second predetermined portion with respect to said inner sleeve.

15. In an apparatus for setting a well tool in a bore, said apparatus being of the type having inner and outer sleeves telescopically interengaged and a vertically shiftable mandrel received within said inner sleeve, a device for locking said mandrel to said inner sleeve, said device comprising:

a slot formed in said inner sleeve and communicating with the inner and outer sides of said sleeve;

a ball received in said slot;

a first groove and a second groove formed thereabove on the radially outer surface of said mandrel, both adapted to receive a portion of said ball when said slot is adjacent thereto;

a locking collar mounted for sliding over the radially outer surface of said inner sleeve, said locking collar including a third groove formed in its radially inner surface for receiving a portion of said ball when said slot is adjacent thereto;

shearable means for mounting said collar on said sleeve in position to maintain a portion of said ball in said first groove; and stop means fixedly mounted above said inner sleeve for effecting shearing of said shearable means during upward movement of said inner sleeve.

16. The device of claim 15 which further includes a lock ring and channel means disposed between said collar and said inner sleeve for mounting said collar on said sleeve in a position to maintain a portion of said ball in said second mandrel groove when the inner sleeve and the mandrel assume a predetermined relative longitudinal position.

17. The apparatus of claim 16 wherein said second mandrel groove is elongate to permit vertical shifting of said mandrel and wherein said device further includes biasing means disposed between said inner sleeve and said mandrel for biasing said mandrel downwardly with respect to said inner sleeve.

* * * * *